US007591236B2

(12) United States Patent
Moeller et al.

(10) Patent No.: US 7,591,236 B2
(45) Date of Patent: Sep. 22, 2009

(54) VENTING CHECK VALVE FOR COMBUSTION NAILER

(75) Inventors: Larry M. Moeller, Schaumburg, IL (US); Yury Shkolnikov, Glenview, IL (US); Walter J. Taylor, McHenry, IL (US)

(73) Assignee: Illinois Tool Works Inc., Glenview, IL (US)

( * ) Notice: Subject to any disclaimer, the term of this patent is extended or adjusted under 35 U.S.C. 154(b) by 82 days.

(21) Appl. No.: 11/885,894

(22) PCT Filed: Mar. 13, 2006

(86) PCT No.: PCT/US2006/008837

§ 371 (c)(1),
(2), (4) Date: Sep. 7, 2007

(87) PCT Pub. No.: WO2006/101789

PCT Pub. Date: Sep. 28, 2006

(65) Prior Publication Data

US 2008/0169326 A1 Jul. 17, 2008

Related U.S. Application Data

(63) Continuation-in-part of application No. 11/182,208, filed on Jul. 15, 2005, now Pat. No. 7,314,028.

(60) Provisional application No. 60/662,112, filed on Mar. 15, 2005.

(51) Int. Cl.
*F02B 71/00* (2006.01)

(52) U.S. Cl. ..... 123/46 SC; 227/10

(58) Field of Classification Search ..... 123/46 SC; 227/10

See application file for complete search history.

(56) References Cited

U.S. PATENT DOCUMENTS

| | | | | | |
|---|---|---|---|---|---|
| 3,278,103 | A | * | 10/1966 | Juilfs et al. | 227/130 |
| 3,406,889 | A | * | 10/1968 | Cast et al. | 227/130 |
| 4,401,251 | A | * | 8/1983 | Nikolich | 227/130 |
| 4,483,473 | A | * | 11/1984 | Wagdy | 123/46 SC |
| RE32,452 | E | | 7/1987 | Nikolich | |
| 4,712,379 | A | | 12/1987 | Nikolich | |
| 4,717,060 | A | | 1/1988 | Cotta | |
| 4,739,915 | A | | 4/1988 | Cotta | |
| 5,199,626 | A | | 4/1993 | Terayama et al. | |
| 5,909,836 | A | | 6/1999 | Shkolnikov et al. | |
| 6,116,489 | A | | 9/2000 | Branston | |
| 2005/0035171 | A1 | | 2/2005 | Ohtsu et al. | |
| 2005/0173486 | A1 | | 8/2005 | Moeller et al. | |

* cited by examiner

*Primary Examiner*—Noah Kamen
(74) *Attorney, Agent, or Firm*—Greer, Burns & Crain, Ltd.; Christopher P. Rauch; Mark W. Croll

(57) ABSTRACT

A combustion nailer configured for reducing intake of contaminated air during operation, includes a combustion engine having a cylinder with a piston reciprocating between a pre-firing position and a fully extended position, and at least one air port in the cylinder below the fully extended position. The at least one air port is provided with a venting check valve configured so that the discharge volume from the cylinder out the at least one air port is greater than the inflow.

19 Claims, 5 Drawing Sheets

VENTING CHECK VALVE FOR COMBUSTION NAILER

RELATED APPLICATIONS

The present application claims priority under 35 USC § 119(e)(1) from U.S. Ser. No. 60/662,112 filed Mar. 15, 2005 and is a Continuation-In-Part of U.S. Ser. No. 11/182,208 filed Jul. 15, 2005 now U.S. Pat. No. 7,314,028.

TECHNICAL FIELD

The present invention relates generally to fastener-driving tools used for driving fasteners into workpieces, and specifically to combustion-powered fastener-driving tools, also referred to as combustion tools or combustion nailers.

BACKGROUND ART

Combustion-powered nailers are known in the art for driving fasteners into workpieces, and examples are described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 5,713,313, all of which are incorporated by reference herein. Similar combustion-powered nail and staple driving tools are available commercially from ITW-Paslode of Vernon Hills, Ill. under the IMPULSE® and PASLODE® brands.

Such nailers incorporate a housing enclosing a small internal combustion engine or power source. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber, turbulence to increase the combustion process, scavenging combustion by-products with fresh air, and cooling the engine. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures created by cooling of residual combustion gases within the cylinder. Fasteners are fed magazine-style into the nosepiece, where they are held in a properly positioned orientation for receiving the impact of the driver blade.

As the piston is displaced in the cylinder, a swept volume of air is discharged through exhaust and vent ports. Following the drive stroke, the vent ports allow atmospheric air to enter the cylinder, on the non-combustion side of the piston, and facilitate the return of the piston via differential pressures.

An operational problem of conventional combustion nailers is that as air required for combustion enters the tool, due to the relatively dirty operational environment, dirt, dust and/or other debris, including but not limited to fragments of nail collation material, sawdust, wallboard particles and the like enters the tool, specifically the cylinder below the piston. This contaminated air enters mainly through the air vent ports located below the exhaust ports as the piston returns to its pre-firing position after combustion. These air ports are typically located below or in close proximity to a shock-absorbing bumper located within the cylinder. Air cannot reenter through the exhaust ports due to the presence of one-way petal valves. Thus, these ports do not contribute to the problem. Among other effects, through prolonged tool operation, these contaminants build up to cause piston malfunctions and deterioration of tool lubricants required for smooth operation of the piston and movement of the reciprocating valve sleeve, the component used to close the combustion chamber. Thus, more frequent cleaning and/or service is required.

Such nailers typically have an air filter located at an upper end of the tool near the combustion chamber fan air intake. However, this filter has been designed to filter air entering the tool and has no effect on the air located below the piston inside the cylinder, where contaminant-caused damage has been known to occur. To address this issue, manufacturers have incorporated a dust boot or shroud over the lower end of the tool. This feature reduces direct exposure of the engine to large contaminants, but is not effective to reduce fine contaminants that enter the cylinder during the piston return cycle. Additionally, such designs are bulky and restrict air flow through the tool. Alternatively, filter elements can be used, but the fine filtration properties of effective filters are prone to clogging when located at the lower end of the nailer, and are restrictive to air flow in and out of the cylinder. Also, the size of any such filter would necessarily be relatively large to permit the passage of sufficient air to maintain proper air circulation within the tool. As such, space, material and tool operational factors combine to discourage tool designers from placing a filter on the tool to filter the air in the cylinder below the piston.

Thus, there is a need for an improved combustion tool configured for reducing the harmful effects of contaminants drawn through the cylinder vent ports, while maintaining effective air flow between the inside and outside of the cylinder.

DISCLOSURE OF INVENTION

The above-listed need is met or exceeded by the present venting check valve for a combustion nailer, which features the ability to differentiate the volume of gases exhausted from the tool from the volume of air intake through the same ports. A greater volume of gases are permitted to be discharged from the cylinder than are allowed to be drawn into the cylinder on the return stroke. The variability in effective port size maintains tool power, facilitates piston return while preventing the entry of contaminants.

More specifically, a combustion nailer configured for reducing intake of contaminated air during operation includes a combustion engine having a cylinder with a piston reciprocating between a prefiring position and a fully extended position, and at least one air port in the cylinder below the fully extended position. The at least one air port is provided with a venting check valve configured so that the discharge or outflow volume from the cylinder out the at least one air port is greater than the inflow.

In another embodiment, a combustion nailer includes a combustion-powered power source having an air intake end and an opposite bumper end, defining a cylinder encircling a reciprocating piston associated with a driver blade, and having at least one air port located at the bumper end below the piston. At least one air intake is provided with an air filter, and an air passageway is in fluid communication with at least one air port and in fluid communication with the air filter for creating a bi-directional air flow between the at least one air port and the at least one air intake during tool operation. A venting check valve is provided and is configured so that the discharge volume from the cylinder out the at least one air port is greater than the inflow, the venting check valve being in fluid communication with the passageway.

BEST MODE FOR CARRYING OUT THE INVENTION

Figure 1:
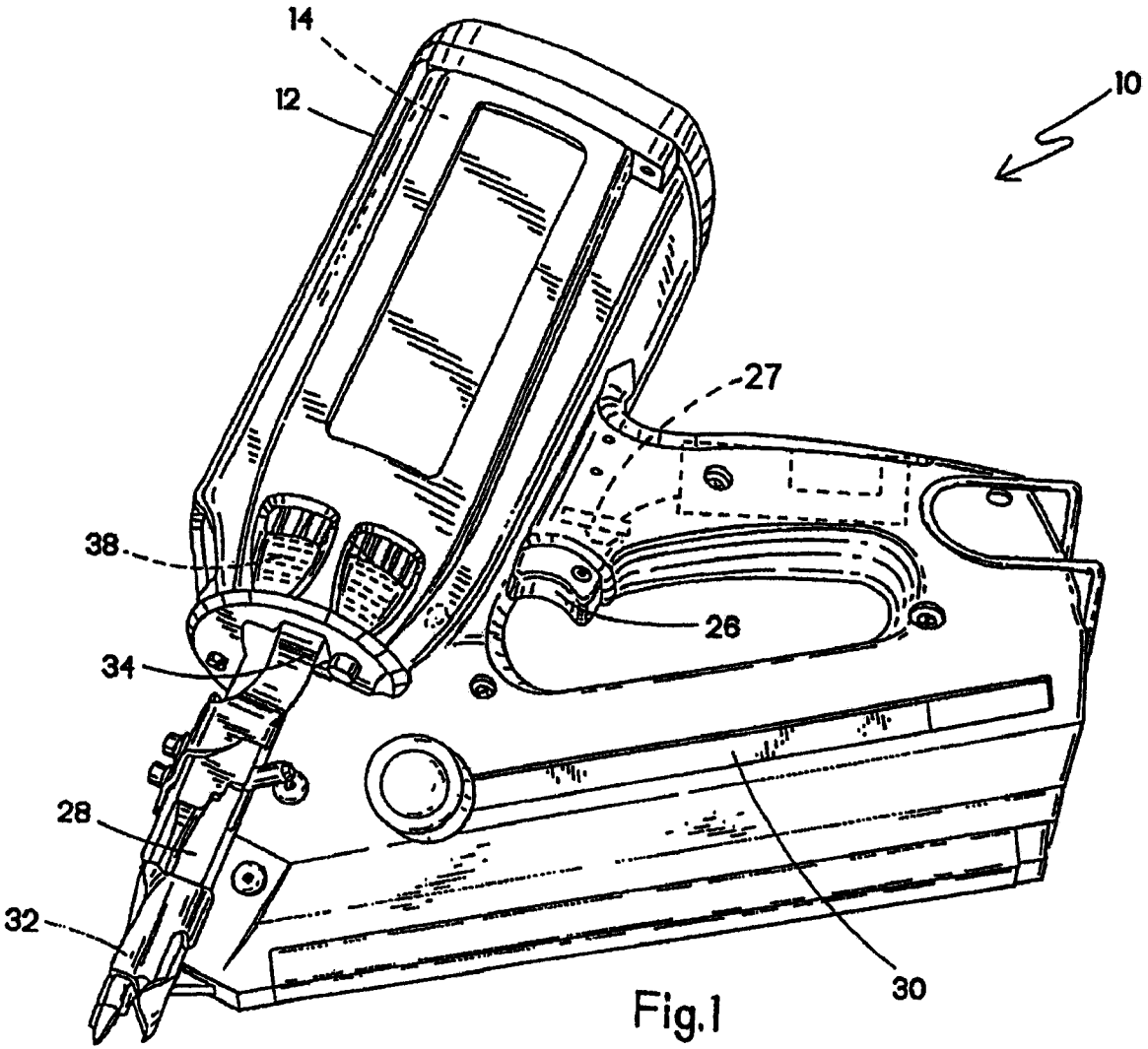
FIG. 1 is a front perspective view of a fastener-driving tool incorporating the present venting check valve.
Figure 2:
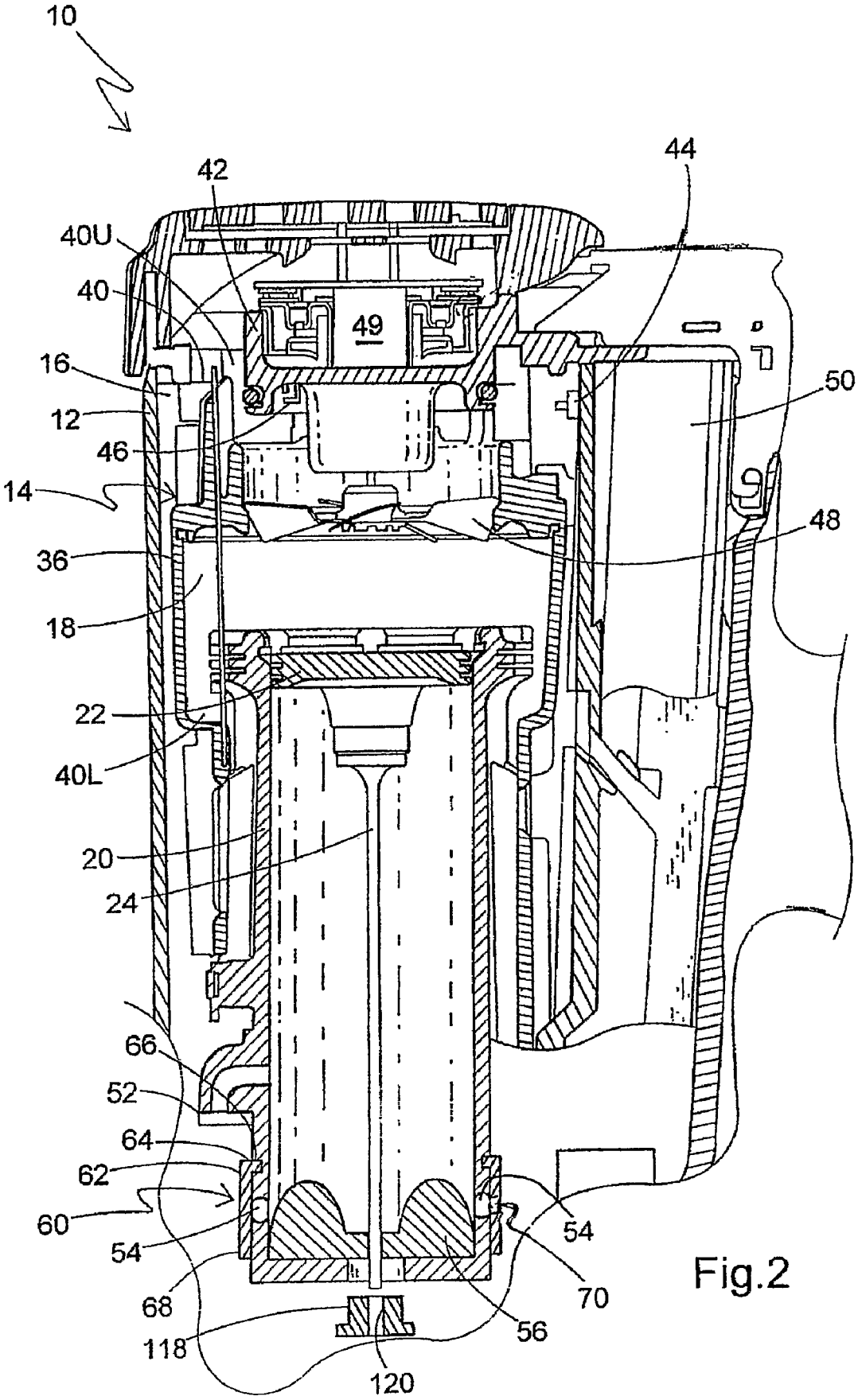
FIG. 2 is a fragmentary vertical cross-section of the tool of FIG. 1 shown in the rest position.

Referring now to FIGS. 1 and 2, a combustion-powered fastener-driving tool, also known as a combustion nailer, incorporating the present venting check valve is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source or combustion engine 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, where ignition of the combustion gases initiates the downward driving of the driver blade 24 to impact a fastener (not shown).

Through depression of a trigger 26 associated with trigger switch 27 the terms trigger and trigger switch are used here interchangeably), an operator induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Adjacent to the nosepiece 28 is a workpiece contact element 32, which is connected, through a linkage 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element to move from a rest position to a pre-firing position. This movement overcomes the normally downward biased orientation of the workpiece contact element 32 caused by a spring 38 (shown hidden in FIG. 1). Other locations for the spring 38 are contemplated.

Through the linkage 34, the workpiece contact element 32 is connected to and reciprocally moves with, the valve sleeve 36. In the rest position (FIG. 2), the combustion chamber 18 is not sealed, since there is an annular gap 40 including an upper gap 40U separating the valve sleeve 36 and a cylinder head 42, which accommodates a spark plug 46, and a lower gap 40L separating the valve sleeve 36 and the cylinder 20. A chamber switch 44 is located in proximity to the valve sleeve 36 to monitor its positioning. In the preferred embodiment of the present tool 10, the cylinder head 42 also is the mounting point for at least one cooling fan 48 and an associated fan motor 49 which extends into the combustion chamber 18 as is known in the art and described in the patents which have been incorporated by reference above. In the rest position depicted in FIG. 2, the tool 10 is disabled from firing because the combustion chamber 18 is not sealed with the cylinder head 42 and the cylinder 20, and the chamber switch 44 is open.

Firing is enabled when an operator presses the workpiece contact element 32 against a workpiece. This action overcomes the biasing force of the spring 38, causes the valve sleeve 36 to move upward relative to the housing 12, closing the gaps 40U and 40L, sealing the combustion chamber 18 and activating the chamber switch 44. This action also induces a measured amount of fuel to be released into the combustion chamber 18 from a fuel canister 50 (shown in fragment).

Upon pulling the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder 20, it pushes a rush of air which is exhausted through at least one petal, reed or check valve 52 and at least one venting port or hole 54, hereafter referred to as ports, located beyond the piston displacement (FIG. 2). At the bottom of the piston stroke or the maximum piston travel distance, the piston 22 impacts a resilient bumper 56 as is known in the art. With the piston 22 beyond the exhaust check valve 52, high pressure gasses vent from the cylinder 20. Due to cooling of the residual gases, internal pressure differentials created in the cylinder 20 cause the piston 22 to be forced back to the pre-firing position shown in FIG. 2.

For combustion nailers that use differential pressures for piston return, atmospheric pressure acts on the non-combustion side of the piston 22. The ports 54 allow air communication between the inside and outside of the tool 10. For some nailers, the ports 54 are sized to assure proper power performance during the drive stroke. This reduces the swept volume air brake that acts on the piston 22, causing power losses. The area of the ports 54 is often larger than the minimum required to effectively return the piston 22. The larger the port area is, the greater the tendency for dirt and contaminants to infiltrate the tool 10.

A feature of the present nailer 10 is that since the air flow required during the drive cycle of the tool 10 is greater than for piston return, a venting check valve or restrictive flow valve, generally designated 60 is placed over the ports 54 for regulating the flow. As the piston 22 reaches the end of its stroke and impacts the bumper 56, the check valve 60 allows the air to discharge out of the cylinder 20 once the inherent offset check valve pressure is overcome. An important feature of the check valve 60 is that it is constructed and arranged to not be a total check to return air flow, but instead to allow a restricted inflow which is less than the piston power stroke discharge described above. The amount of restricted inflow may vary with the application, but preferably is the minimum required for effective piston return. The minimum area can be a single or multiple ports that can be connected or plumbed to another area of the tool.

As seen in FIG. 2, the check valve 60 preferably surrounds the cylinder 20 adjacent the ports 54, and is preferably a rubber-like flap or a spring steel band which is radially expandable upon exposure to sufficient air pressure. Other means of creating one-way flow are also contemplated, such as a reed petal or spring biased plate or ball valves. While other types of attachment are contemplated, the check valve 60 is preferably secured at an upper end 62 to the cylinder 20, such as by a radially inwardly projecting lip 64 engaging an annular groove 66.

Figure 2A:
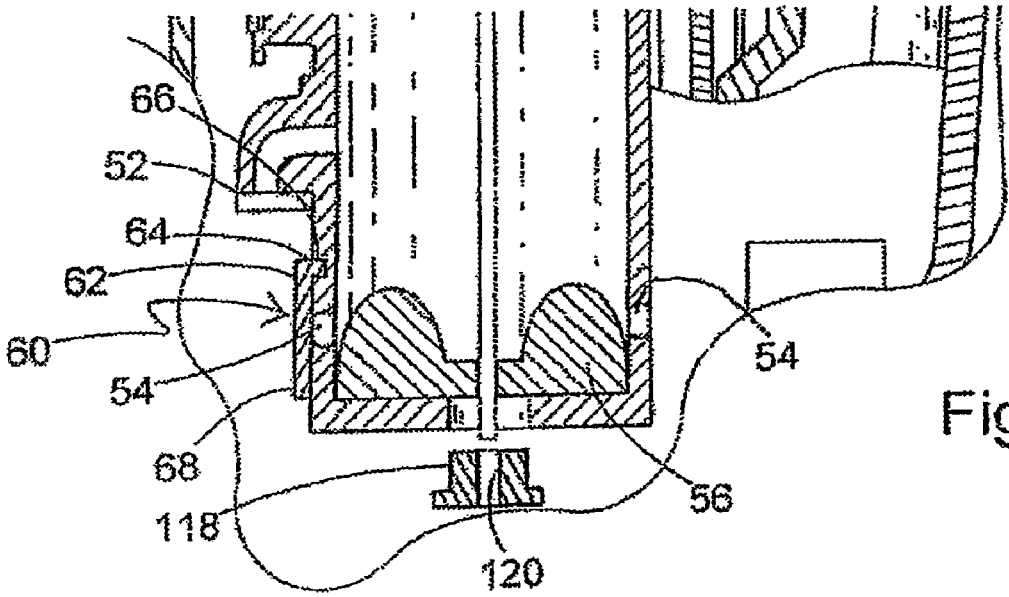
FIG. 2A is a fragmentary vertical cross-section of the tool of FIG. 2 depicting a modified venting check valve.

To permit the restricted inflow of ambient air, a web portion 68 is provided with at least one aperture 70 in fluid communication with ports 54, however it is contemplated that the aperture need not be in direct registry with the corresponding port, as long as internally directed airflow is permitted. Additionally, the sectional areas of the apertures 70 may be larger or smaller than the sectional areas of ports 54. As shown in FIG. 2, the apertures 70 are smaller in sectional area than the associated ports 54. The number of apertures 70 may vary to suit the application, and it is contemplated that the number of apertures may be more or less than the number of ports 54. It is also contemplated that at least one port 54 is not covered or obstructed by any portion of the check valve 60 (See FIG. 2A).

Figure 3:
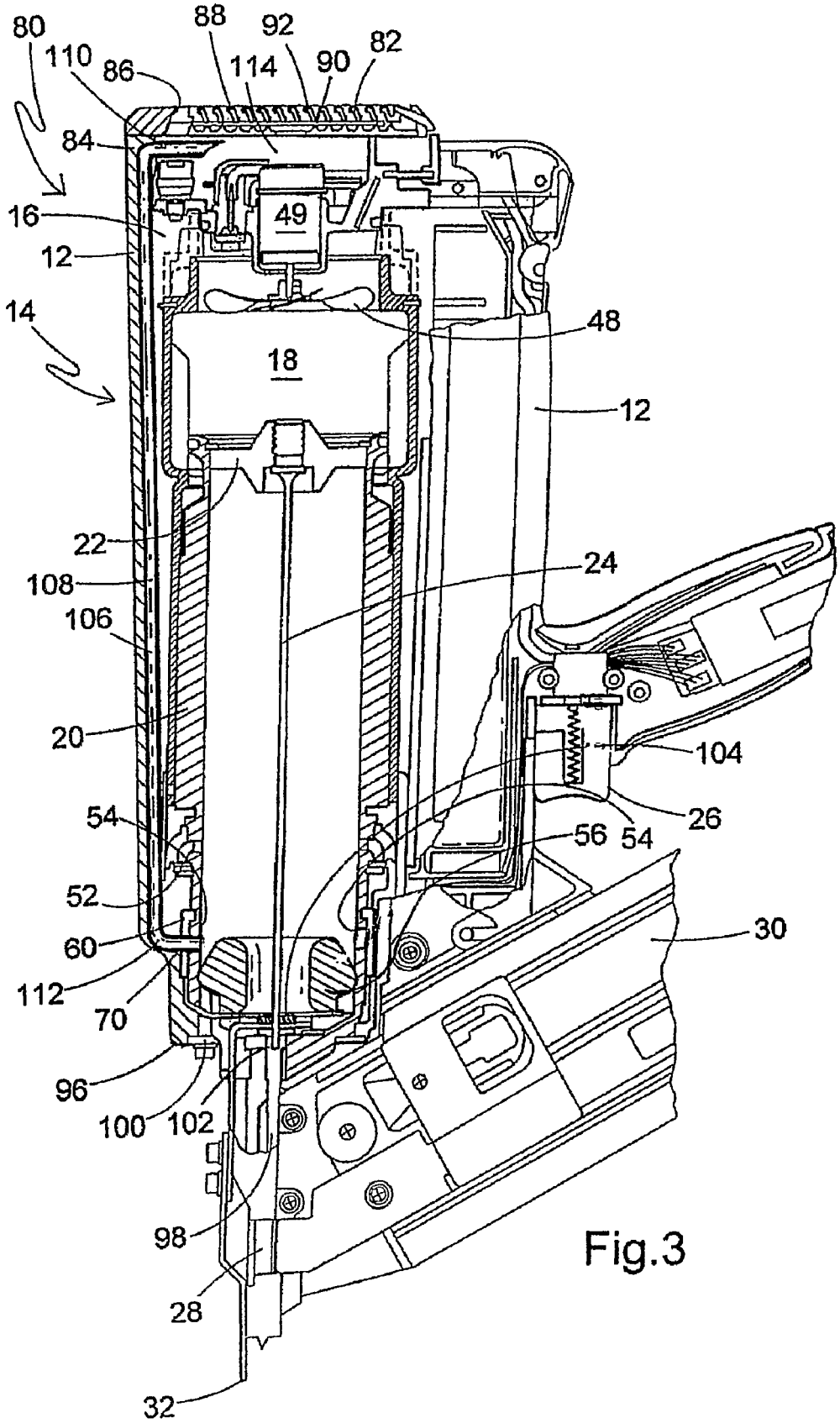
FIG. 3 is a fragmentary vertical cross-section of an alternate embodiment of the tool depicted in of FIG. 2.

Referring now to FIG. 3, a combustion nailer provided with an alternate embodiment of the present venting check valve is generally designated 80. Shared components with the nailer 10 are designated with the same reference number. Also, it is contemplated that the nailer 80 preferably be constructed and arranged to include all of the features of the nailer 10.

Included on the housing 12 is a cap 82 that closes an upper end 84 of the housing and defines an air intake end 86 with an air intake 88 in the cap. An air filter 90 is associated with the cap 82 as is known in the art and is supported by a protective grille 92. As is well known in the art, the air filter 90 is releasably secured to the cap 82. The air filter 90 is made of a porous material such as plastic or metal mesh, foam or the like that is designed to allow the passage of air into the housing 12, but prevent the ingress of construction debris, dirt and other operational contaminants.

Opposite the upper end 84, a lower end 96 of the tool 80 has a driver blade passageway 98 in the nosepiece 28 that slidingly accommodates the driver blade 24. An endplate 100 defines a central aperture 102 through which the driver blade 24 passes, as well as air when the piston 22 reciprocates during operation. Thus, the central aperture 102 may also be termed an air port, however it is also contemplated that the port 54 is such an air port or that other air ports may be provided in the end plate 100 or in lower portions of the cylinder 20.

A grommet or wiping seal 104 is located at a lower end of the cylinder 20 just above an upper end of the nosepiece 28 for preventing air from escaping from the air port towards the nosepiece, while permitting relative sliding action of the driver blade 24 in the passageway 98.

An important feature of the nailer 80 is the provision of at least one air passageway, generally designated 106, in fluid communication with the at least one air port 54, 102 and in operational relationship with the air filter 90. The at least one air passageway 106 creates fluid communication (the preferable fluid being air) between the lower end of the cylinder 20 and the air filter 90, as well as the air intake 88. While in the preferred embodiment the air filter 90 is provided for filtering air entering the tool 10, it is also contemplated that additional or dedicated air filters and associated air intakes may be provided which are provided specifically for connection to the passageway 106. For clarity, only the filter 90 will be presently described.

Thus, air entering the cylinder 20 as the piston 22 returns to the pre-firing position shown in FIG. 2 must first pass through the filter 90. Also, during the combustion cycle, air is forced out of the air port 54, as well as the venting check valve 60.

In the preferred embodiment, the passageway 106 is provided in the form of at least one tube, also referred to as an interconnection tube, having a central section 108 generally parallel with an operational axis of the piston 22, and upper and lower ends 110, 112 preferably projecting at generally right angles to the central section formed as radiused bends for effecting connection respectively to the air intake and the at least one air port 54. The specific angular orientation of the upper and lower ends 110, 112 may vary to suit the situation. While depicted as at least one continuous tube, it is also contemplated that the passageway 106 be defined by tubular segments joined by fixed angle fittings, or individual component configurations that create a passageway in a finished assembly.

More specifically, the upper end 110 is preferably secured within an air chamber 114 defined by the cap 82 below the air filter 90. Conventional techniques for securing the upper end 110 are contemplated, including but not limited to friction fit, chemical adhesives, clips, rigid fittings or the like. It is also considered that the upper end 110 is in fluid communication with the housing main chamber 16 that is downstream of the air filter 90.

It is preferred that the central section 108, and at least a majority of the upper and lower ends 110, 112 of the passageway 106 extends inside the main housing 12 along the combustion engine 14. If necessary, the main housing 12 can be radially extended to encompass the passageway 106. As a further alternate embodiment, the passageway 106 can be integrally molded with the housing 12. It is also contemplated that the passageway 106 may be disposed externally of the housing 12. The passageway 106 is preferably manufactured of a tubing of sufficient durability to withstand the potential impacts and temperatures typically experienced by combustion nailers.

At the lower end 112, the passageway 106 is placed in fluid communication with the interior of the cylinder 20 through the exhaust opening or air port 54. It is preferred that the lower end 112 not protrude into the cylinder 20 to avoid interference with the piston 22, however a protruding tube is acceptable if the entrance point in the cylinder is located below the lowermost point of piston travel. The lower end 112 is ultimately secured to a bottom portion of the cylinder 20 and passes through the venting check valve 60 and at least one of the apertures 70 to maintain this fluid communication. Similar fastening techniques described above relative to the upper end 110 are employable for securing the lower end 112 in position. It will be understood that all such apertures 70 will be in communication with the air passageway 106, such as by a manifold (not shown) or other suitable connector fitting known in the art. However, it is also contemplated that there are additional exhaust openings 54 not provided with apertures 70 and not in communication with the passageway 106 in view of the larger volume of discharge gases upon combustion compared to the intake volume needed for piston return.

The sectional area of the passageway 106 is determined so that only sufficient volume of air is admitted for effecting piston return. This area will vary depending on the type of nailer 80 and the size of the combustion power source 14.

Referring again to FIG. 2, it will be seen that instead of the grommet or wiping seal 104, a replaceable plug 118 is provided which is fixable in the driver blade passageway 98 and includes an opening 120 for slidingly accommodating the driver blade 24.

Figure 4:
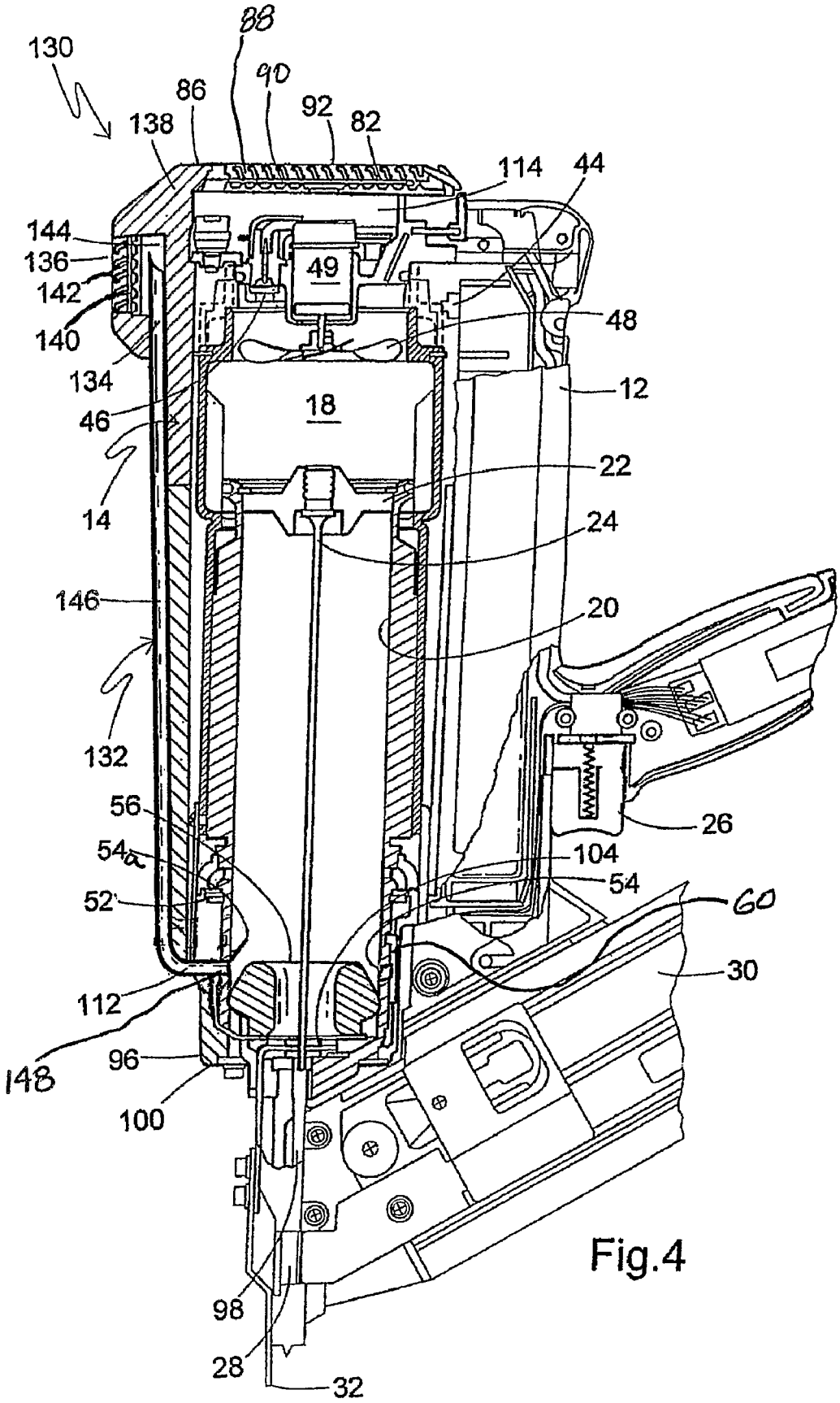
FIG. 4 is a fragmentary vertical cross-section of another alternate embodiment of the tool depicted in FIG. 2.

Referring now to FIG. 4, another embodiment of the present nailer is generally designated 130, and shared components with the tools 10 and 80 are designated with identical reference numbers. The nailers 80 and 130 are very similar in construction. In the tool 130 a passageway is generally designated 132 and is formed externally on the housing 12.

A main difference between the tools 130 and the tool 80 is that an upper end 134 of the passageway 132 is not in communication with the air intake 88, but is in fluid communication with at least one supplemental air intake 136 located in a specially reconfigured upper end 138 of the main housing 12. However, both the air intake 88 and the supplemental air intake 136 are preferably located at or adjacent the air intake end 86. The supplemental air intake 136 is preferably provided with its own filter 140, protective grille 142 and a supplemental air chamber 144 with which the upper end 134 is in fluid communication. In some applications, it is contemplated that the filter 140, the protective grille 142 and the supplemental air chamber 144 would be eliminated. It is also contemplated that the at least one supplemental air intake 136 may be located on the main housing in any suitable location which is satisfactorily remote from the relatively high operational temperatures of the combustion power source 14.

While the upper end 134 of the passageway 132 is shown as a vertically projecting extension of a central portion 146, other angular orientations or other configurations are contemplated as long as fluid communication with the air port 54 is maintained. Also, as is the case with the nailers 10 and 80, while the passageway 132 is shown on a periphery of the housing 12, an internal disposition is also contemplated. The operation of the embodiment 130 is substantially the same as described above in relation to the embodiment 80, with the primary difference being that the chamber 144 does not also supply air to the combustion power source 14, more specifically combustion chamber 18.

Another feature of the nailer 130 is that, as is shown in FIG. 3, the lower end 112 of the passageway 132 optionally passes through the venting check valve 60 and the associated aperture 70. It is also contemplated that the passageway 132 could enter the cylinder 20 in dependently of the venting check valve 60 as shown at 148, passing directly through the cylinder wall and the associated air port 54*a*. Such an arrangement is also contemplated for the tool 80 shown in FIG. 3. In the embodiment of FIG. 4, it is contemplated that the venting check valve 60 would be designed to accommodate the direct engagement of the passageway 132 with the port 54*a* without interfering with operation of the check valve.

Thus, it will be seen that the present nailer features a venting check valve for providing selective intake of return air once combustion has occurred. Once implemented, the present venting check valve system provides for reduced tool maintenance, a reduction in required lubrication, reduced wear and more regulated flow communication between the inside and outside of the sleeve.

While particular embodiments of the present venting check valve for a combustion nailer have been described herein, it will be appreciated by those skilled in the art that changes and modifications may be made thereto without departing from the invention in its broader aspects and as set forth in the following claims.

The invention claimed is:

1. A combustion nailer configured for reducing intake of contaminated air during operation, comprising:

a combustion engine having a cylinder with a piston reciprocating between a prefiring position and a fully extended position;

at least one air port in said cylinder below said fully extended position;

said at least one air port being provided with a venting check valve configured so that the discharge volume from the cylinder out said at least one air port is greater than the inflow; and an exhaust valve in communication with said cylinder and located between said at least one air port and said prefiring position.

2. The combustion nailer of claim 1 wherein said venting check valve is configured for having a default closed position, and for opening only upon exposure to air generated by said piston during a power stroke.

3. The combustion nailer of claim 1 wherein said venting check valve is provided with at least one aperture in fluid communication with said at least one air port in said cylinder.

4. The combustion nailer of claim 3 wherein said at least one aperture has a sectional area smaller than that of the at least one air port.

5. The combustion nailer of claim 3 wherein said venting check valve surrounds said cylinder to engage said at least one air port.

6. The combustion nailer of claim 1 further including a driver blade passageway in said cylinder receiving a driver blade attached to said piston, and at least one seal disposed in said opening for restricting airflow into said cylinder while accommodating reciprocation of said driver blade.

7. The combustion nailer tool of claim 6 wherein said seal is a wiping seal.

8. The combustion nailer of claim 6 wherein said seal is a replaceable plug.

9. The combustion nailer of claim 1 further including at least one air intake located on a tool housing; and at least one air passageway is in fluid communication with said at least one air intake and said at least one air port.

10. The combustion nailer of claim 9 wherein the air intake is provided with an associated air filter.

11. The combustion nailer of claim 9 further including a tool housing enclosing said power source and defining an air chamber at an air intake end, said passageway being in fluid communication with said air chamber.

12. The combustion nailer of claim 9 wherein said at least one air intake for the passageway is independent of the at least one air intake for the combustion engine.

13. The combustion nailer of claim 9 wherein said at least one air passageway is a tube.

14. The combustion nailer of claim 9 wherein said at least one passageway is at least one interconnecting tube having a central section generally parallel with an operational axis of the piston, and upper and lower ends projecting at generally right angles to said central section for effecting connection respectively to said at least one air intake and said at least one air port.

15. The combustion nailer of claim 9, further including a plurality of said air ports, wherein said at least one passageway is disposed to be in communication with said cylinder through a separate air port from said at least one air port engaged by said venting check valve.

16. A combustion nailer, comprising:

a combustion-powered power source having an air intake end and an opposite bumper end, defining a cylinder encircling a reciprocating piston associated with a driver blade, and having at least one air port located at said bumper end below said piston;

at least one air intake being provided with an air filter;

an air passageway in fluid communication with said at least one air port and in fluid communication with said air filter for creating a hi-directional air flow between said at least one air port and said at least one air intake during tool operation; and a venting check valve configured so that the outflow volume from the cylinder out said at least one air port is greater than the inflow.

17. The combustion nailer of claim 16 wherein said at least one air intake includes a first filtered air intake associated with providing air into a combustion chamber, and a supplemental filtered air intake for supplying air to said passageway and receiving air from said bumper end during tool operation.

18. The combustion nailer of claim 16 wherein said venting check valve is in fluid communication with said passageway.

19. A combustion nailer configured for reducing intake of contaminated air during operation, comprising:

a combustion engine having a cylinder with a piston reciprocating between a prefiring position and a fully extended position;

a plurality of air ports in said cylinder below said fully extended position;

at least one of said air ports being provided with a venting check valve configured so that the discharge volume from the cylinder out said at least one air port is greater than the inflow; wherein said venting check valve is provided with at least one aperture in fluid communication with at least one of said air ports in said cylinder.

* * * * *